US010364092B2

(12) United States Patent
Schroer et al.

(10) Patent No.: US 10,364,092 B2
(45) **Date of Patent: *Jul. 30, 2019**

(54) SINGLE ACTION DISPENSING DEVICE WITH SLIDING SLEEVE

(71) Applicant: Dow Global Technologies LLC, Midland, MI (US)

(72) Inventors: Daniel R. Schroer, Saginaw, MI (US); Marc S. Black, Midland, MI (US); Chad V. Schuette, Freeland, MI (US); Christopher J. Siler, Hemlock, MI (US)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/780,715

(22) PCT Filed: Jan. 31, 2017

(86) PCT No.: PCT/US2017/015747
§ 371 (c)(1),
(2) Date: Jun. 1, 2018

(87) PCT Pub. No.: WO2017/139128
PCT Pub. Date: Aug. 17, 2017

(65) Prior Publication Data

US 2018/0354709 A1 Dec. 13, 2018

Related U.S. Application Data

(60) Provisional application No. 62/410,411, filed on Oct. 20, 2016, provisional application No. 62/292,884, filed on Feb. 9, 2016.

(51) Int. Cl.
*B65D 83/34* (2006.01)
*B65D 83/20* (2006.01)
(Continued)

(52) U.S. Cl.
CPC ..... *B65D 83/345* (2013.01); *B65D 83/202* (2013.01); *B65D 83/207* (2013.01); *B65D 83/303* (2013.01); *B65D 83/46* (2013.01)

(58) Field of Classification Search
CPC .. B65D 83/345; B65D 83/202; B65D 83/207; B65D 83/303; B65D 83/46; B65D 83/201
(Continued)

(56) References Cited

U.S. PATENT DOCUMENTS 3,266,680 A * 8/1966 Newman ..... B65D 47/283 222/519
3,305,127 A * 2/1967 Baranne ..... B65D 47/242 220/259.3

(Continued)

FOREIGN PATENT DOCUMENTS

EP 1688186 8/2006
WO 9843913 10/1998

*Primary Examiner* — Benjamin R Shaw

(57) ABSTRACT

A dispensing device that attaches to a container has: (a) a hollow tube with opposing entrance and exit ends with a connector on the entrance end and a wall defining a flow channel; (b) a sleeve with opposing entrance and exit ends slidably extending over the hollow tube; (c) a sealing gasket between and contacting the hollow tube and sleeve; (d) a trigger mount rigidly attached to the hollow tube or container; (e) a trigger hingedly connected to the trigger mount and operatively connected to the sleeve; (f) an elastic element between the trigger and the hollow tube and/or container; wherein the exit end is closed and there is an opening through the hollow tube wall proximate to the exit end; the sleeve has an open dispensing end, reduces in inside diameter at dispensing end and engages the hollow tube when closed and disengages from the hollow tube when open.

10 Claims, 4 Drawing Sheets

(51) Int. Cl.
*B65D 83/30* (2006.01)
*B65D 83/46* (2006.01)

(58) Field of Classification Search
USPC ..... 222/522
See application file for complete search history.

(56) References Cited

U.S. PATENT DOCUMENTS

| | | | | | |
|---|---|---|---|---|---|
| 3,450,316 | A * | 6/1969 | Barker | B65D 83/46 | 137/614.11 |
| 3,506,165 | A * | 4/1970 | Beard | B65D 83/46 | 222/402.22 |
| 3,584,789 | A * | 6/1971 | Traynor | B65D 83/20 | 222/149 |
| 3,777,947 | A * | 12/1973 | Klema | B65D 83/207 | 222/402.23 |
| 5,549,226 | A * | 8/1996 | Kopp | B65D 83/303 | 222/402.13 |
| 5,624,055 | A * | 4/1997 | Clanet | B65D 83/206 | 222/135 |
| 5,887,756 | A * | 3/1999 | Brown | B05B 1/3046 | 222/136 |
| 8,720,747 | B2 | 5/2014 | Hoagland et al. | | |
| 2007/0090133 | A1* | 4/2007 | Macleod | B65D 83/206 | 222/402.13 |
| 2014/0158718 | A1* | 6/2014 | Demey | B65D 51/00 | 222/402.1 |
| 2014/0224828 | A1* | 8/2014 | Demey | B05B 1/3073 | 222/23 |
| 2016/0223097 | A1* | 8/2016 | Demey | B65D 83/303 | |

* cited by examiner

SINGLE ACTION DISPENSING DEVICE WITH SLIDING SLEEVE

BACKGROUND OF THE INVENTION

Field of the Invention

The present invention relates to a dispensing device for dispensing compressed fluid from a pressurized container.

Introduction

Dispensing fluid, particularly foamable fluid, from a compressed can is useful for many products including whipped dairy toppings and spray foam for sealing and thermal insulation applications. Foamable fluid is often available as foamable liquid under pressure in a can that is dispensed through an application tube attached to a valve or valve stem on the can. Upon release from the pressurized can the foamable fluid expands into foam.

One challenge with spray foam is that residual foamable formulation in the application tube of the dispenser is free to continue to expand after applying spray foam formulation to a location. The residual foamable liquid continues to expand and expel from the application tube even after application of the foamable liquid is complete. The expanding residual foamable liquid can drip from the application tube to create unintended messes. Alternatively, the user must periodically wipe clean the dispensing end of the application tube as residual foamable liquid expands within the application tube. To avoid drips and the need to continually wipe the end of an application tube, it is desirable to have a dispensing device for use with compressed expandable liquids that would obviate continuous expansion of residual foamable liquid out from an application tube after desired application of the foamable liquid is complete. Moreover, it is desirable to have such a dispensing device that is operable with a single action and using a single hand to dispense the foamable fluid and then to seal the application tube when done dispensing.

U.S. Pat. No. 5,549,226 ('226) discloses a device for operating propellant cans that can be useful for addressing the aforementioned problem. The device in '226 comprises a bendable application tube that can bend back on itself and the open end of the tube placed over a nipple to seal it. Inserting a nipple into the end of an application tube from outside the application tube will itself displace fluid out from the application tube around the nipple resulting in foam being undesirably disposed around the nipple area and possibly the fingers of a user. In contrast to the device of '226, it is desirable to avoid having to insert anything from outside the dispensing tube into the end of the dispensing tube in order to seal the end. It also requires two hands to reposition the nipple into the straw, during which time foam can undesirably continue to expel from the straw.

The Dow Chemical Company offers a foam dispensing gun for GREAT STUFF PRO™ brand spray foam. The spray gun is available in three different grades: PRO 13, PRO 14 and PRO 15. Each of the guns has a port onto which a can of GREAT STUFF PRO™ brand spray foam attaches thereby releasing the compressed foam formulation into a barrel of the gun.

Upon attaching the can to the dispensing gun, the valve of the can is held in the open position so pressurized contents of the can are continuously free to exit the can through the valve. Therefore, the dispensing gun controls when the pressurized contents can flow through the dispensing gun and when they cannot. Extending through the barrel is a rod that is spring loaded to seal from inside the barrel an outlet or dispensing end of the barrel. A trigger is attached to the spring loaded rod so that upon pulling the trigger the rod is retracted from the dispensing end of the barrel and foam formulation is free to flow from the can through the barrel around the retracted rod and out from the dispensing end. Upon release of the trigger the spring repositions the rod back into sealing position in the dispensing end of the barrel. This dispensing gun design requires a rod to extend through the barrel thereby decreasing the open volume inside the barrel available for transporting foam formulation and thereby restricting foam formulation flow through the barrel. It is desirable to have a dispensing device capable of sealing but without requiring a rod to extend through the entire barrel of the dispensing device. Moreover, it is desirable to have a dispensing device that does not hold the pressurized container in the open position at all times, but rather only opens the valve stem of a pressurized container when dispensing of the contents of the container is desired.

U.S. Pat. No. 8,720,747 discloses a single-action dispenser that requires a plug in the dispensing straw that is pressed into the exit opening of the straw by fluid pressure to seal the straw and is displaced from the exit opening into the straw to dispense the foamable fluid from the straw. It is desirable to identify a dispenser that does not require fluid pressure to seal the dispenser. It is further desirable to avoid having to displace a plug into the straw to dispense the fluid because the plug can still inhibit fluid flow in the straw.

BRIEF SUMMARY OF THE INVENTION

The present invention solves the aforementioned problems by providing a dispensing device that is suitable for dispensing compressed fluids, including foamable fluids, that is operable with a single action using a single hand both to open a can and dispensing device to dispense the foamable fluid and then to close the can and seal the dispensing device when done dispensing without needing to remove fingers of the hand from the trigger, that does not require a rod to extend through the entire barrel of the dispensing device, does not cause the can to which it is attached to be held open at all times and that does not require a plug that requires fluid pressure to seal the dispenser or that is displaced into the dispenser when dispensing fluid.

In a first aspect, the present invention is a dispensing device (10) for attaching to a container (100) that has a valve stem (110), the dispensing device comprising: (a) a hollow tube (20) having opposing entrance (22) and exit (24) ends, a wall (25) extending between the entrance and exit ends that defines a flow channel (27) through the hollow tube and that separates inside the hollow tube from outside the hollow tube with the inside being within the wall of the hollow tube, and a connector (26) on the entrance end for attaching to the valve stem of the container; (b) a sleeve (30) extending over a portion of the outside of the hollow tube and capable of sliding over the hollow tube, the sleeve extending over the exit end of the hollow tube and having an entry end (32) and an opposing dispensing end (34) with the dispensing end proximate to the exit end of the hollow tube; (c) a sealing gasket (40) around the outside of the hollow tube between and contacting the wall of the hollow tube and the sleeve, the sealing gasket positioned such that it prevents fluid communication past the sealing gasket outside of the hollow tube between the sleeve and the hollow tube, the seal located between the exit and entrance ends of the hollow tube; (d) a trigger mount (50) that is part of or that rigidly attaches to the hollow tube; (e) a trigger (60) hingedly connects to the trigger mount in a first location (62) with a sleeve portion (64) of the trigger extending towards the sleeve from the first location and a trigger extension portion (66) extending on the opposing side of the first location from the sleeve portion, where the sleeve portion operatively engages with the sleeve at a second location (68) in a manner that causes the sleeve portion to slide the sleeve towards the exit end of the hollow tube when the trigger extension portion is displaced relative to the trigger mount in a direction away from the exit end of the hollow tube when the sleeve is in the closed position; (f) an elastic element (70) that provides a restorative force to the trigger to replace the sleeve in the closed position when the trigger extension portion is displaced away from the exit end of the hollow tube thereby placing the sleeve into the open position; and wherein the exit end of the hollow tube is closed and there is one or more than one hole (28) extending all the way through the wall of the hollow tube proximate to the exit end; and wherein the sleeve has an open dispensing end and reduces in inside diameter proximate to the dispensing end such that when the dispensing end of the sleeve slides towards the exit end of the hollow tube to a closed position for the dispensing device, the hollow tube and sleeve engage so as to block fluid flow out from the dispensing end of the sleeve and from flowing between the sleeve and hollow tube by gasket material (40) yet when the dispensing end moves away from the hollow tube into an open position for the dispensing device the one or more than one hole (28) is open to allow fluid communication from inside the hollow tube into the sleeve and out from the dispensing end of the hollow tube.

The dispensing device of the present invention is useful for dispensing pressurized fluids from a container, including dispensing pressurized foamable fluids such as spray foam sealants.

BRIEF DESCRIPTION OF THE DRAWINGS

FIG. 7(*a*) illustrates a tope view of the dispensing device. FIG. 7(*b*) illustrates a side view of the dispensing device. FIG. 7(*c*) illustrates a cut-away side-view of the dispensing device as viewed along viewing line A shown in 7(*a*). FIG. 7(*d*) illustrates an enlarged view of a portion of the cut-away view of 7(*c*).

FIG. 8 further illustrates an elastic element in the form of a spring coiled around the hollow tube and attached to the sleeve and hollow tube. FIG. 8(*a*) illustrates a side view of the dispensing device. FIG. 8(*b*) illustrates a cut-away top view of the dispensing device as viewed along viewing line A of FIG. 8(*a*). FIG. 8(*c*) illustrates an enlargement of a portion of the cut-away view of 8(*b*).

DETAILED DESCRIPTION OF THE INVENTION

Figure 1:
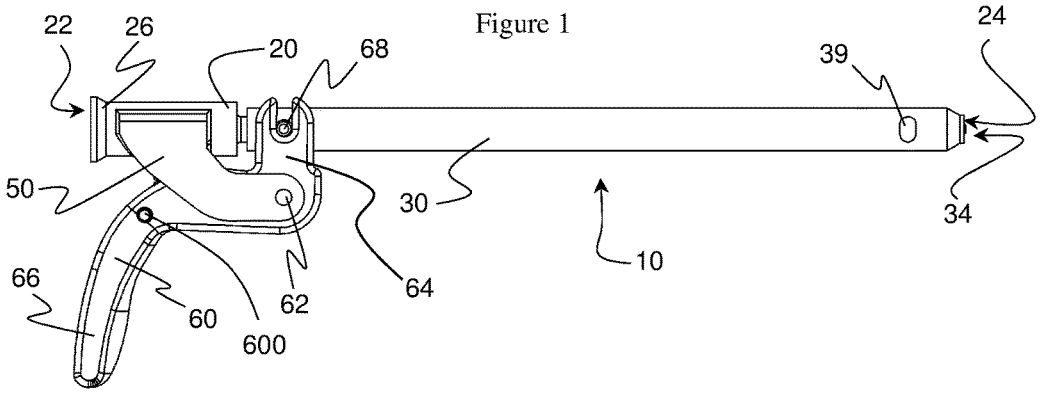
FIG. 1 is a side view of an embodiment of the dispensing device of the present invention.
Figure 2:
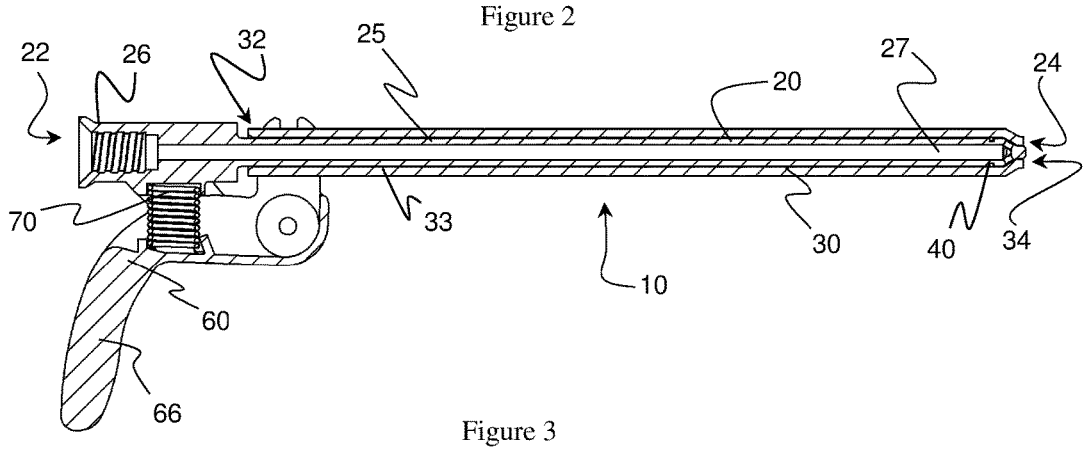
FIG. 2 is a cut-away side view of the dispensing device embodiment from FIG. 1.
Figure 3:
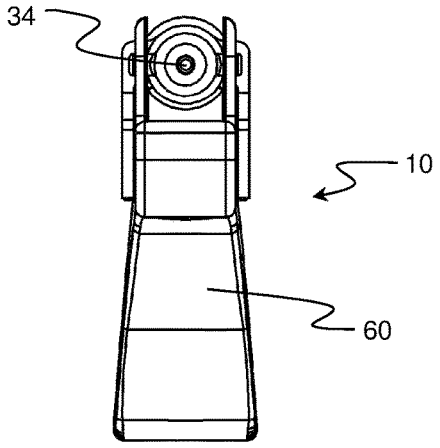
FIG. 3 is an end view of the dispensing device embodiment of FIGS. 1 and 2 as viewed towards the dispensing end of the sleeve.

"And/or" means "and, or alternatively". All ranges include endpoints unless otherwise stated. "Multiple" means more than one. "Fluid" refers to a substance that has no fixed shape and yields to external pressure and includes gas, liquid and gas or liquid continuous formulations. Typically, though not necessarily, fluid refers to liquid and liquid continuous formulations.

The following description references FIGS. 1-8 for illustrative purposes to facilitate understanding. For avoidance of any doubt, the illustrated embodiments in FIGS. 1-8 are not necessarily illustrations of the broadest scope of the present invention or components of the present invention. The following description generally identifies the element number from the Figures only with the first mention of the element for the sake of easier reading.

The present invention is a dispensing device (10) that is useful for attaching to a valve stem (110) of a container (100) and dispensing pressurized fluid from the container through the valve stem. The container can be any vessel suitable for holding pressurized fluid. Suitable containers include those selected from a group consisting of cans, bottles, and bags. The valve stem of a container is that portion of the container that is outside of the container and that connects or contains a valve that controls access to and/or from inside of the container. Tilting or depressing the valve stem towards the can opens the valve and releases pressurized contents from the can. The dispensing device attaches to the valve stem of the container so that a connector of the hollow tube of the dispensing device fits over the valve stem so that contents of the container can flow out through the valve stem and into the flow channel of the hollow tube.

Dispensing device (10) comprises a hollow tube (20). The hollow tube has an entrance end (22) and an opposing exit end (24). The hollow tube has a length defined by the distance between the entrance end and the exit end. The hollow tube has a wall (25) extending between the entrance and exits ends of the hollow tube that defines a flow channel (27) through the hollow tube. The wall separates the inside (within the flow channel) from the outside of the hollow tube. Inside the hollow tube is within the wall (that is, within the flow channel) and between the entrance and exit ends of the hollow tube.

Entrance end (22) is open (that is, defines an opening allowing access between the inside and outside of the hollow tube) while the exit end (24) is not open (that is, it is closed). There is a hole (28), preferably multiple holes (28), extending all the way through the wall (25) proximate the exit end (24). Because the hole or holes extend through the wall (and are therefore not located through the exit end), the holes are considered to be on the side of hollow tube. The one or more than one hole (28) desirably extends generally perpendicular to the flow channel (27), which means they have a vector component that extends perpendicularly to the flow channel. The one or more than one hole (28) can extend perpendicularly to the flow channel or, preferably, extend at such an angle that the portion of a hole (28) most proximate to the outside of the hollow tube is more proximate to the exit end than the portion of the hole (28) most proximate to the inside of the hollow tube such as those illustrated in FIG. 4. When in use, fluid enters the hollow tube through the entrance end and exits the hollow tube through the one or more than one holes (28) proximate to the exit.

Desirably, though not necessarily in the broadest scope of the invention, the flow channel of the hollow tube is essentially linear. Essentially linear, with respect to the hollow tube, means there is a straight line between a point on a cross section of the hollow tube at the entrance end and a point on a cross section of the hollow tube at the exit end. Preferably, the flow channel of the hollow tube is linear, which means there is a straight line between the center of a cross section of the entrance end of the hollow tube and the center of a cross section of the exit end of the hollow tube. It is desirable for the flow channel of the hollow tube to be essentially linear or even linear, to facilitate sliding of the sleeve (30) back and forth along the length of the hollow tube.

The entrance end of the hollow tube includes a connector (26) for attaching the dispensing device to a valve stem of a container. The connector can be integral with the hollow tube (that is, defined in a single piece of material with the hollow tube). Alternatively, the connector can be a separate piece of material that is attached to another piece of the hollow tube so as to form a continuous flow channel through the connector and rest of the hollow tube. In general, the hollow tube can be a single piece or multiple connected pieces that can be of the same or different material provided there is a flow channel that continuously extends through the hollow tube while dispensing material through the dispensing device. The connector can be threaded on the inside wall (that is, the wall exposed to the flow channel) in such a way so as to enable it to screw onto a valve stem of a container.

The hollow tube can be a single piece of material or comprise multiple pieces of material connected together. For example, the one or more than one hole (28) can be in a removable piece, or tip, that connects with the rest of the hollow tube to form the complete hollow tube. Having one or more than one hole (28) on a removable piece of the hollow tube is convenient both for manufacturing of the hollow tube but also for replacing or cleaning in case the one or more than one hole (28) become plugged. Desirably, such a removable tip containing the one or more than one hole (28) extends less than half the length of the hollow tube. At the same time, or alternatively, connector (26) can be a removable piece of material that attaches to the rest of the hollow tube. When the hollow tube comprises multiple pieces connected together, the pieces can be made of the same material or different materials with respect to one another. For example, one or more than one piece of material can be metal while at the same time one or more than one piece can be plastic.

The hollow tube can be narrower in outside diameter at the exit end than at the entrance end. For example, the hollow tube can taper to a narrower diameter proximate to the exit end. Alternatively, the hollow tube can have a step change in diameter that is narrower proximate to the exit end and optionally can further have a taper before or after the step change in diameter. The change in outside diameter can, but does not necessarily, correspond to a change in inside diameter (diameter of the flow channel) of the hollow tube. For instance, the outside diameter can change without changing the inside diameter. Alternatively, the inside and outside diameters can both change either at equal proportions or different proportions. Desirably, the one or more than one hole (28) is on the taper or narrower portion of the hollow tube. For avoidance of doubt, diameter and cross sections of the hollow tube are perpendicular to the flow channel through the hollow tube.

A sleeve (30) extends over a portion of the outside of the hollow tube. The sleeve is capable of sliding over the hollow tube, which means the sleeve can slide back and forth along the length of the hollow tube. Sliding the sleeve over the hollow tube moves the sleeve (and dispensing device) between an open and closed position. Sliding the sleeve towards the entrance end of the hollow tube moves the sleeve and dispensing device into its closed position and moving the sleeve towards to exit end of the hollow tube moves the sleeve and dispensing device into its open position. When the sleeve is in an open position then the dispensing device is in an open position. When the sleeve is in a closed position then the dispensing device is in a closed position.

The sleeve is desirably cylindrical in shape having a wall (33) that defines a channel through the sleeve in which the hollow tube resides. Alternatively, the sleeve can be partially cylindrical with a wall defining a channel therethrough but not fully wrapping around the channel on every, or possibly even any, cross section of the sleeve. Cross section of the sleeve and cross section of the channel refers to a cross section taken perpendicular to the channel extending through the sleeve. Whether the sleeve is entirely cylindrical or not, the sleeve is desirably cylindrical between the dispensing end (34) and a sealing gasket (40), described below, so as to ensure fluid flows out from the dispensing end of the sleeve when the dispensing device used to apply fluid from a container.

The sleeve has an entry end (32) and an opposing dispensing end (34). The entry end is proximate to the entrance end of the hollow tube while the dispensing end is proximate to the exit end of the hollow tube. The dispensing end is open, meaning there is fluid communication between the inside (within the channel defined by the sleeve walls) and outside of the sleeve through the dispensing end of the sleeve. In that regard, the sleeve has defined one or more than one dispensing hole proximate to the dispensing end of the sleeve that allows fluid to flow from the hollow tube flow channel through the exit end and out from the sleeve's dispensing end when the sleeve is in an open position.

The channel through the sleeve reduces in diameter proximate to the dispensing end. Channel diameter is measured along a cross section of the channel. The diameter of the channel is the "inside diameter" of the sleeve. The inside diameter can reduce gradually such as by means of tapering or can reduce in one or more steps. Desirably, the outside diameter of the sleeve also reduces in size proximate to the dispensing end. The outside diameter can reduce proportionally with the inside diameter (that is, diameter of the channel through the sleeve) or distinct from the inside diameter. The design of the present dispensing device that includes an inside diameter that reduces also enables reduction of the outside diameter. Reduction of the outside diameter is useful and desirable. It is desirable to maintain as large of an inside diameter for the hollow tube as possible to efficiently move fluid when dispensing, but a large diameter hollow tube requires a large diameter sleeve. However, large diameter hollow tube requires a large diameter sleeve, which inhibits reaching the dispensing device into small openings to dispense fluid. Reducing the hollow tube and sleeve in diameter proximate to the dispensing end of the sleeve allows for a large diameter hollow tube for most of the dispensing device while enabling a smaller diameter sleeve at the dispensing end to reach into smaller openings to dispense fluid.

Figure 4:
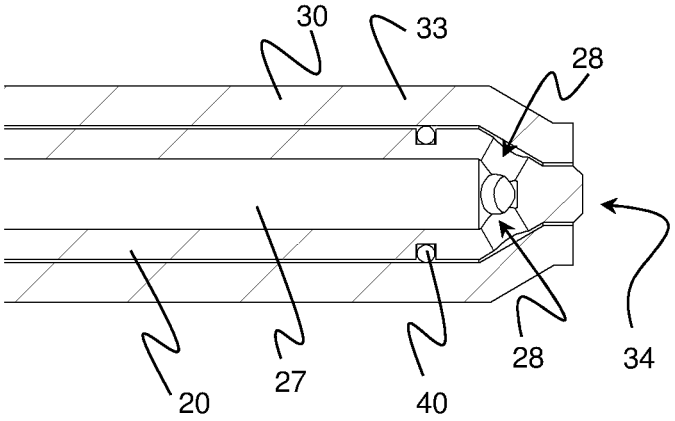
FIG. 4 illustrates a blown-up cut-away side view of the exit end of the hollow tube and dispensing end of the sleeve in a closed orientation.
Figure 5:
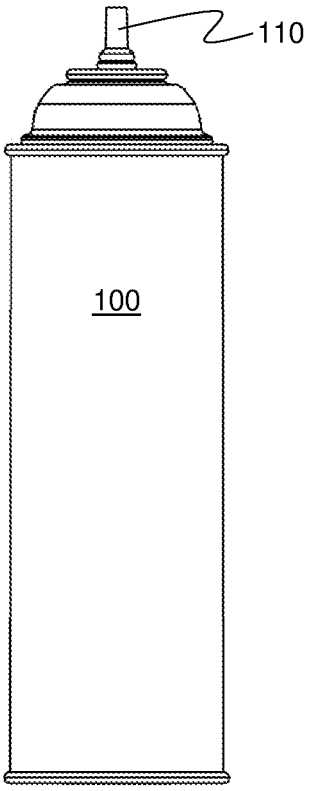
FIG. 5 illustrates a container with a valve stem.
Figure 6:
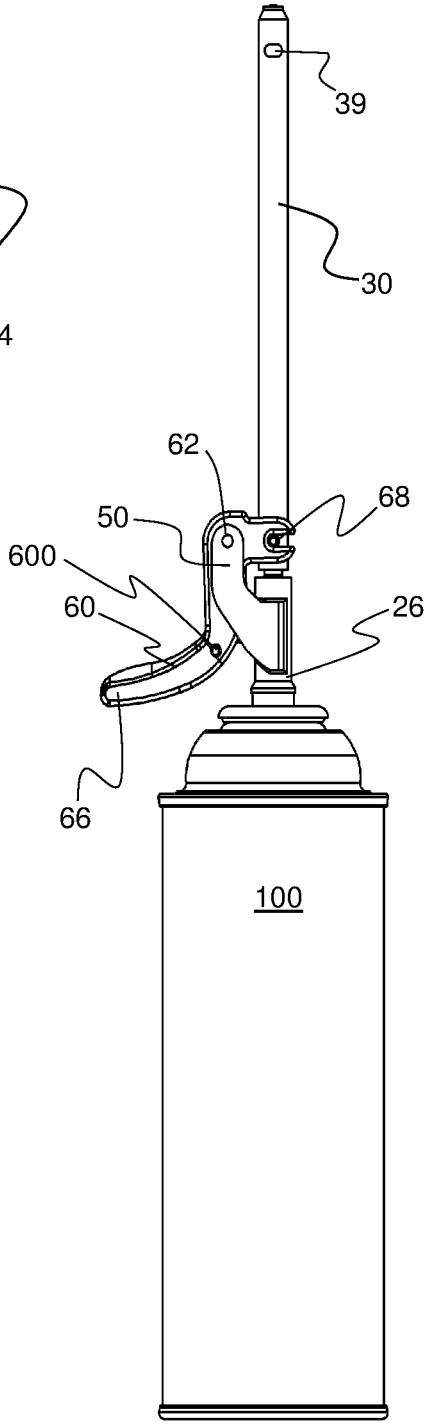
FIG. 6 illustrates the dispensing device of FIGS. 1 and 2 attached to the valves stem of the container of FIG. 5.
Figure 7:
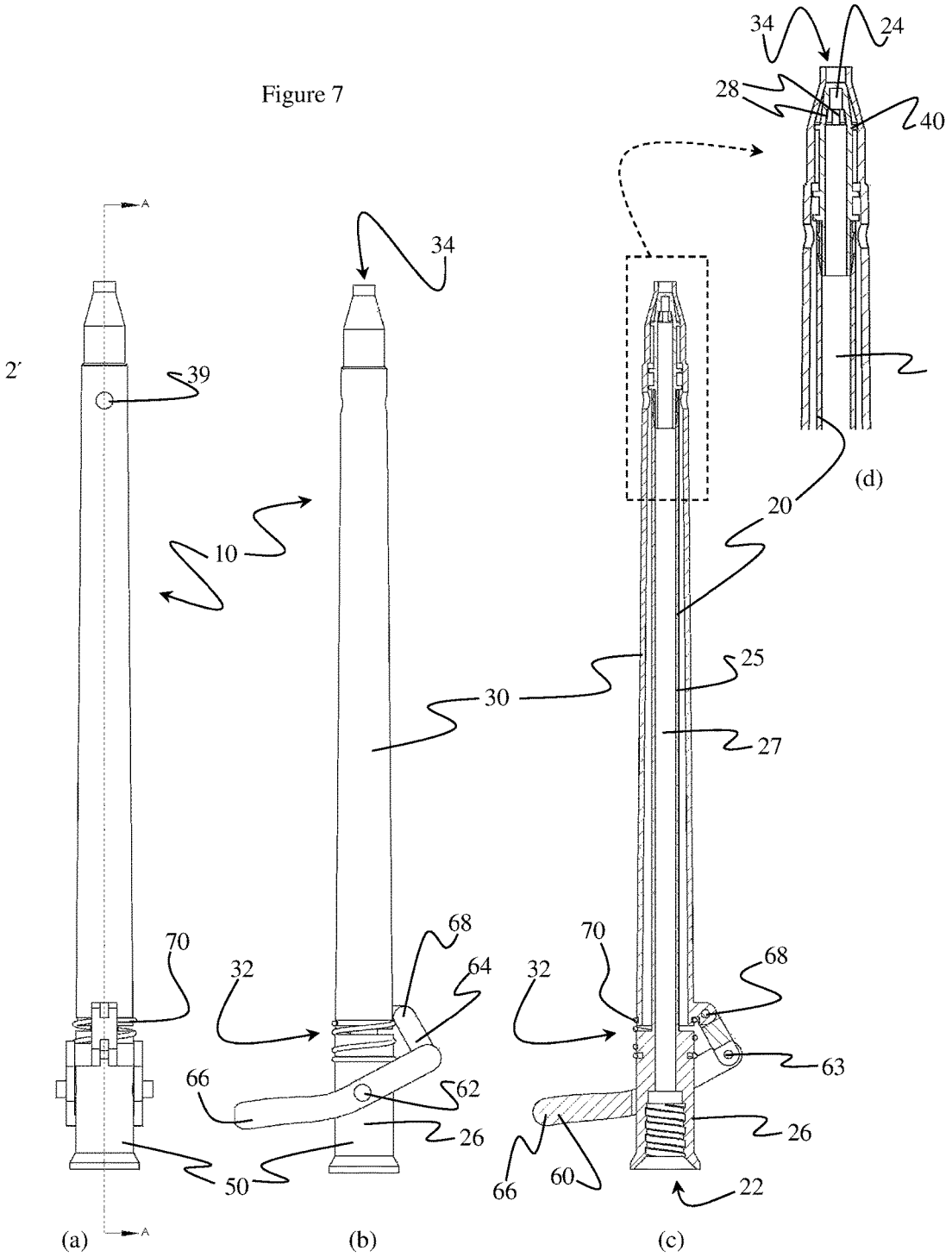
FIG. 7 illustrates a dispensing device of the present invention where the base of the hollow tube serves as the trigger mount.
Figure 8:
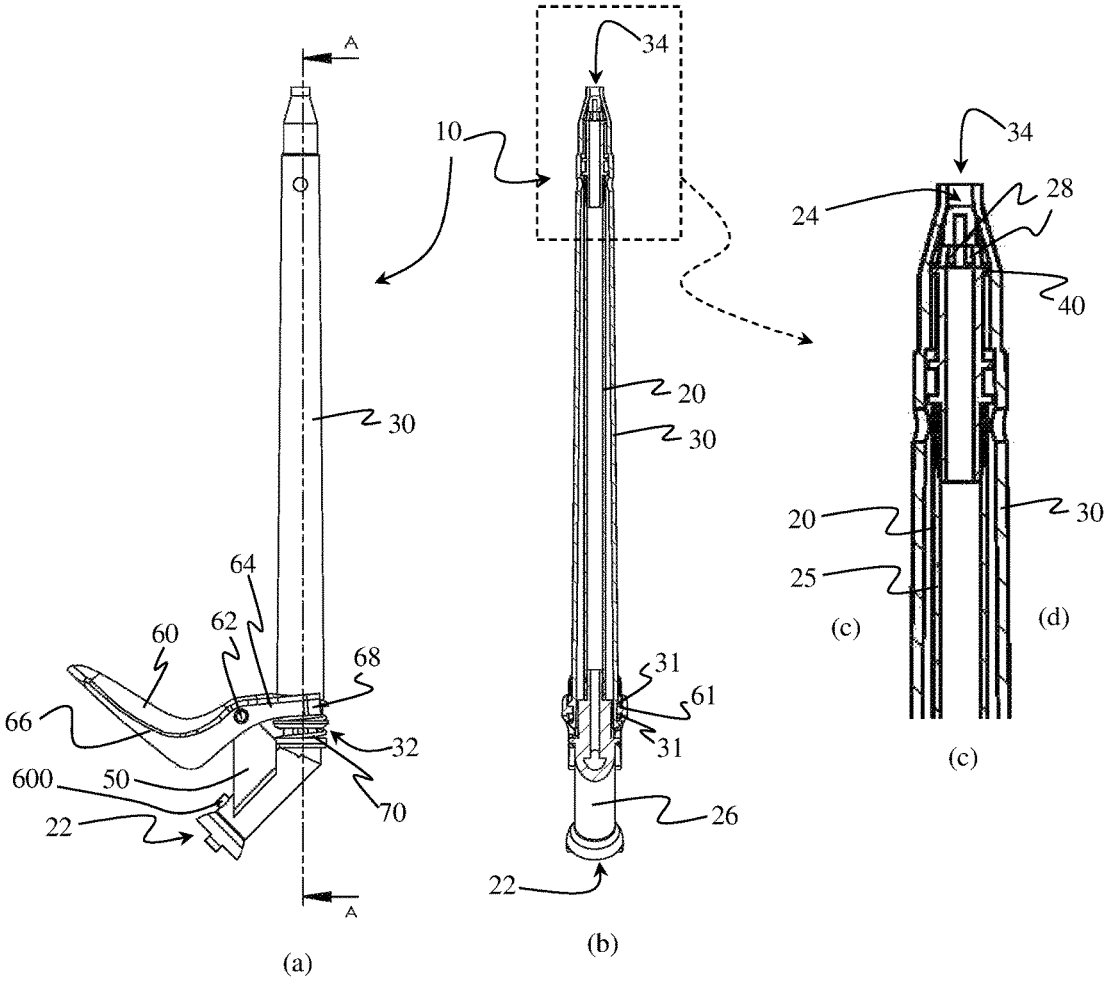
FIG. 8 illustrates a dispensing device having a sleeve end of the trigger operatively engaging the sleeve by having a portion of the trigger fitting between protrusions (that is, within a slot) on the sleeve.

When the dispensing device is in a closed position the hollow tube and sleeve engage to form a seal so as to block fluid flow out from the dispensing end of the sleeve and to block fluid from flowing between the sleeve and hollow tube towards the entrance end of the sleeve between the sleeve and hollow tube by the gasket (40). That is, when the dispensing device is in a closed position, flow of fluid through the hollow tube ceases. In the broadest scope, the hollow tube can engage the sleeve in the closed position to form the seal in any way. For example, as shown in FIG. 4, the closed exit end of the hollow tube can insert into the dispensing end of the sleeve to seal off the dispensing end. As shown in FIGS. 7 and 8, the exit end of the hollow tube can press against the inside of the sleeve proximate to the dispensing end to form a seal thereby preventing fluid flow from holes 28 out through the dispensing end of the sleeve. Alternative to these configurations, or in addition to them, the sleeve can press against the hollow tube around holes 28 to form a seal directly over the holes 28, or protrusions can extend from the sleeve into the holes 28 of the hollow tube to form a seal. In each case, sliding the sleeve away from the entrance end of the hollow tube breaks the seal preventing fluid flow from the holes 28 and out through the dispensing end of the sleeve.

Notably, when the dispenser is in an open position fluid can flow from flow channel 27 through hole or holes 28 and out from dispensing opening of the sleeve.

The sleeve can be a single piece of material or multiple pieces of material connected together. For example, the sleeve can comprise a removable tip on the dispensing end that reversibly attaches to the rest of the sleeve. Having a separate removable tip allows for replacement of the tip or just cleaning of the tip and dispensing device. A removable tip can be designed with the rest of the sleeve so as to allow the tip to snap into place, for example by means of a ridge or ridges in one piece that mates with a groove or grooves in the other piece when snapped together. When the sleeve comprises multiple pieces of material connected together, the pieces can be made of the same or different material. Examples of suitable materials for the sleeve and hollow tube are described below.

The sleeve can have defined in it a window (39) that extends all the way through the wall of the sleeve and located proximate to the dispensing end of the sleeve. Opening 39 can be merely a characteristic of the method of manufacture or it can serve a useful purpose in the operation of the dispensing device. For example, the dispensing device can have a position indicator comprising a hollow tube with a first color at the exit end and a second color proximate to (but not at) the exit end where the two colors of the hollow tube are located such that the first color is apparent through the opening (39) when the sleeve is in the closed position and the second color is apparent through the opening (39) when the sleeve is in the open position. Such a position indicator allows visual indication of when the dispensing device is in the open position and when it is in the closed position to ensure a user that the device is in the position desired. The dispensing device can comprise or be free of a position indicator that reveals when the dispensing device is in an open position versus a closed position. For example, the dispensing device can be free of a position indicator by being free of opening 39, one or both colors on the hollow tube or by being free of any combination of colors and opening 39.

Sealing gasket (40) resides around the outside of the hollow tube between the wall of the hollow tube and the sleeve along the length of the hollow tube, preferably proximate to the exit end of the hollow tube and dispensing end of the sleeve. The sealing gasket contacts both the wall of the hollow tube and the sleeve in a manner that prevents fluid flow past the sealing gasket along the outside of the hollow tube between the hollow tube and the sleeve. The sealing gasket acts as a barrier preventing fluid exiting the exit end of the hollow tube to travel along between the hollow tube and sleeve past the sealing gasket and instead forces the fluid to exit the dispensing end of the sleeve. The sealing gasket desirably wraps all the way around the outside of the hollow tube (for example, a ring of material around the hollow tube). The sealing gasket can be attached to or part of (that is, integral with such as molded into) either the outside of the wall of the hollow tube or the inside of the sleeve. Conceivably, the sealing gasket can be attached to neither the hollow tube nor sleeve but rather frictionally held between the hollow tube and sleeve. The sealing gasket can be a rigid material such as a rigid plastic, but is preferably an elastic material that contacts one or both of the hollow tube and sleeve so that the sealing gasket can conform to both the hollow tube and sleeve to form a fluid impervious seal even as the sleeve slides along the hollow tube between open and closed positions. Examples of suitable elastic sealing gasket materials include rubber materials such as nitriles and ethylene propylene diene monomer rubber (EPDM). The sealing gasket is desirably between the window (39) and the dispensing end of the sleeve so as to prevent fluid from undesirably flowing out from window (39).

The dispensing device further comprises a trigger mount (50). The trigger mount can be part of the hollow tube (such as, for example, connector (26) that connects the hollow tube to the valve stem) or the trigger mount can be one or more than one projection extending from the hollow tube on two opposing sides of the hollow tube. When the trigger mount is the hollow tube it is desirable for the hollow tube to extend through the trigger with a pin or other hinging connector connecting the trigger to the hollow tube. See, for example, FIG. 7 which illustrates trigger 60 hingedly attached at first location 62 to connector 26 of hollow tube 20, which serves as the trigger mount 50. Trigger 60 includes trigger extension portion 66 and hingedly attaches to sleeve 30 at second location 68. Trigger 60 desirably extends on opposing sides of connector 26 and is hingedly connected to both opposing sides of connector 26 at first location 62. Trigger 60 in FIG. 7 also include an additional hinged joint 63.

Desirably, the trigger mount comprises two projections extending from the hollow tube on two opposing sides of the hollow tube with the trigger extending between the two projections forming the trigger mount. In such a configuration, the trigger has opposing ends and one of the two opposing ends of the trigger is hingedly attached to the sleeve, a location between opposing ends of the trigger hingedly attached to the protrusions of the hinge mount, and the unattached end of the trigger extending beyond the trigger mount to serve as the trigger extension portion. The trigger can be hingedly attached to the sleeve and trigger mount by any means that allows motion in a plane such as a pin extending from one and into (or through) the other of the two pieces hingedly connected.

A trigger (60) hingedly connects to the trigger mount in a first location (62). A sleeve portion (64) of the trigger extends towards the sleeve from the first location 62 and a trigger extension portion (66) of the trigger extends on the opposing side of the first location 62 from the sleeve portion. The sleeve portion 64 operatively engages with the sleeve at a second location (68) in a manner that causes the sleeve portion to slide the sleeve towards the exit end of the hollow tube when the trigger extension portion is displaced relative to the trigger mount in a direction away from the exit end of the hollow tube. In the broadest scope of the invention, the sleeve portion can operatively engage with the sleeve in any conceivable manner provided that the engagement causes the sleeve portion to slide the sleeve towards the exit end of the hollow tube when the trigger extension portion is displaced relative to the trigger mount in a direction away from the exit end of the hollow tube. Examples of suitable forms of "operatively engaging" the sleeve portion of the trigger with the sleeve include any one or combination of more than one of the following: (a) rigidly attaching the sleeve portion of the trigger to the sleeve; (b) hingedly attaching the sleeve portion of the trigger to the sleeve; (c) positioning the sleeve portion of the trigger on the entrance end side (relative to the hollow tube) of one or more than one protrusion extending out from the sleeve so that displacing the trigger extension is displaced relative to the trigger mount in a direction away from the exit end of the hollow tube the sleeve portion of the trigger presses against the one or more than one protrusion to slide the sleeve towards the exit end of the hollow tube; (d) positioning the sleeve portion of the trigger so that at least a portion of it extends between protrusions extending out from the sleeve such that at least a portion of the sleeve portion of the trigger has a protrusion of the sleeve both on the exit end and entrance end side of it relative to the hollow tube (that is, a portion of the sleeve portion of the trigger resides in a slot on the sleeve).

For illustration purposes, FIGS. 1, 2, 6 and 7 illustrate embodiments of the present invention where the sleeve end of the trigger operatively engages the sleeve by hingedly attaching to the sleeve. FIG. 8 illustrates a portion (61) of the trigger operatively engaging the sleeve with a portion of the sleeve extending between protrusions (31) or in other words within a slot of the sleeve.

The dispensing device can comprise one or more than one stopping feature (600) that limits the extent to which the trigger extension portion can be displaced away from the exit end of the hollow tube. A suitable stopping feature includes one or more than one protrusion from the trigger extension portion that contacts the trigger mount once displaced a certain distance and thereby preventing further displacement. Another suitable stopping feature is a protrusion from the trigger extension portion, the hollow tube, or both that contacts both the trigger extension portion and hollow tube when the trigger is displaced a certain distance thereby preventing further displacement.

An elastic element (70) provides restorative force to the trigger to replace the sleeve into a closed position when the trigger extension portion is displaced away from the exit end of the hollow tube thereby placing the sleeve in an open position. The location and form of the elastic element is not critical in the broadest scope of the present invention as long as the required restorative force is achieved.

For example, the elastic element can be one or more than one element selected from a group consisting of springs, a bent or bowed piece of metal or plastic, an elastic bead and an elastic pad positioned between the trigger and the hollow tube such that the elastic element is deformed by compressing, bending, stretching or otherwise distorting when the trigger extension portion is displaced to put the sleeve in the open position. The deformed elastic element then applies a restorative force to move the trigger extension portion back towards the exit end of the hollow tube and restoring the sleeve to a closed position. Suitable springs include both metal and plastic springs. Elastic beads and elastic pads can be, for example, elastic foam materials, rubber materials, or other elastic plastic materials. Springs can be, for example, helical or leaf springs.

When the elastic element is between the trigger and the hollow tube then the elastic element can also serve as a similar function as a stopping feature (600) by preventing the trigger from traveling beyond a certain distance when moving the sleeve into an open position. For example, a spring or elastic bead or elastic pad can become fully compressed as the trigger is pulled and then cease to compress thereby preventing the trigger from moving further in the direction that compresses the spring.

Elastic element 70 can be or can include a spring with opposing ends where the spring is coiled around the hollow tube between the connector (26) and sleeve (30) and where one end of the spring is connected to the hollow tube below the sleeve (for example, at the connector) and the opposing end is attached to the sleeve. See, for example, FIGS. 7 and 8, where elastic element 70 is a spring around the hollow tube and attached to the sleeve and hollow tube such that it stretches when the dispensing device is moved into an open position and the restorative force of the spring to return from a stretched position provides a restorative force to the sleeve to slide the dispensing device to a closed position when the force holding it in an open position is relieved. The material from which the elements of the dispensing device are made are non-limiting in the broadest scope of the invention unless otherwise stated herein. However, it is desirable for at least those portions of the sleeve and hollow tube that contact fluid while dispensing fluid with the dispensing device, or even the entire sleeve and/or hollow tube, to be made of material that has a low adhesive affinity for material dispensed from the dispensing device in order to facilitate clean up and preclude plugging of the dispensing device. Examples of material having a low adhesive affinity for fluid dispensed from the dispensing device include, for example, a material selected from a group consisting of metal, polyethylene, polypropylene, polytetrafluoroethylene and nylon. When the hollow tube comprises multiple pieces each piece may be the same or different material, preferably selected from the material listed herein Likewise, when the sleeve comprises multiple pieces, each piece can be the same or different material, preferably selected from the material listed herein.

The dispensing device of the present invention attaches to the valve stem of a container (can). For example, the valve stem and the connector of the dispensing device can have mating threads so that the connector can screw onto (over) the valve stem. As another example, the connector of the dispensing device can snap into place over the valve stem by, for example, having ridges of one of the pieces snap into grooves of the other piece.

The valve of the container remains closed when the dispensing device is attached to the valve stem of the container until actively opened. Applying pressure to the trigger extension portion of the dispensing device so as to move the sleeve into an open position also depresses and/or tilts the valve stem of the container so as to open the valve of the container to release pressurized fluid from the container into the hollow tube of the dispensing device. Releasing pressure on the trigger extension portion allows the elastic element to reposition the dispensing device into a closed position and the valve stem to reposition so as to close the valve to the container. Therefore, applying pressure to the trigger extension portion of the dispensing device opens both the valve of the container and moves the dispensing device into an open position. Releasing pressure on the trigger extension portion of the dispensing device when it is in an open position causes the dispensing device to move to a closed position and the valve of the container to close. Hence, the single action of applying pressure or releasing pressure on the trigger extension portion of the dispensing device opens and closes the container and dispensing device respectively without requiring a second hand to move anything. Moreover, the dispensing device seals proximate to or at the dispensing end of the sleeve so foamable composition does not drip out from the dispensing device when application of the foamable composition is ceased.

The dispensing device of the present invention affirmatively positions the sleeve in a closed position when the trigger is not actively moved to place the sleeve in an open position due to the restorative force applied by the elastic element. This is a valuable feature of the present dispending device. When the dispensing device is in a closed position fluid in the hollow tube is prevented from flowing out from the dispensing device and air and moisture from the surrounding air is prevented from reaching any fluid in the hollow tube. The latter aspect is particularly important for moisture curable foam where the fluid in the hollow tube can react with moisture in air. When moisture curable foam formulation is in a dispensing tube exposed to air the moisture in the air can cure the formulation in the tube and plug it, preventing future use of the dispenser. The present dispending device avoids that problem by sealing the hollow tube from surrounding air when not in use.

The invention claimed is:

1. An article comprising a dispensing device (10) for attaching to a container (100) that has a valve stem (110), the dispensing device comprising:

(a) a hollow tube (20) having opposing entrance (22) and exit (24) ends, a wall (25) extending between the entrance and exit ends that defines a flow channel (27) through the hollow tube and that separates inside the hollow tube from outside the hollow tube with the inside being within the wall of the hollow tube, and a connector (26) on the entrance end for attaching to a valve stem of the container;

(b) a sleeve (30) extending over a portion of the outside of the hollow tube and capable of sliding over the hollow tube, the sleeve extending over the exit end of the hollow tube and having an entry end (32) and an opposing dispensing end (34) with the dispensing end proximate to the exit end of the hollow tube;

(c) a sealing gasket (40) around the outside of the hollow tube between and contacting the wall of the hollow tube and the sleeve, the sealing gasket positioned such that it prevents fluid communication past the sealing gasket outside of the hollow tube between the sleeve and the hollow tube, the seal located between the exit and entrance ends of the hollow tube;

(d) a trigger mount (50) that is part of or that rigidly attaches to the hollow tube;

(e) a trigger (60) hingedly connects to the trigger mount in a first location (62) with a sleeve portion (64) of the trigger extending towards the sleeve from the first location and a trigger extension portion (66) extending on the opposing side of the first location from the sleeve portion, where the sleeve portion operatively engages with the sleeve at a second location (68) in a manner that causes the sleeve portion to slide the sleeve towards the exit end of the hollow tube when the trigger extension portion is displaced relative to the trigger mount in a direction away from the exit end of the hollow tube when the sleeve is in the closed position;

(f) An elastic element (70) that provides a restorative force to the hollow tube when the trigger extension portion is displaced away from the exit end of the hollow tube;

and wherein the exit end of the hollow tube is closed and there is one or more than one hole (28) extending all the way through the wall of the hollow tube proximate to the exit end; and wherein the sleeve has an open dispensing end and reduces in inside diameter proximate to the dispensing end such that when the dispensing end of the sleeve slides towards the exit end of the hollow tube to a closed position for the dispensing device, the hollow tube and sleeve engage so as to block fluid flow out from the dispensing end of the sleeve and gasket material (40) blocks fluid flow between the sleeve and hollow tube yet when the dispensing end moves away from the hollow tube into an open position for the dispensing device the one or more than one hole (28) is open to allow fluid communication from inside the hollow tube into the sleeve and out from the dispensing end of the hollow tube.

2. The article of claim 1, wherein there are multiple holes extending all the way through the wall of the hollow tube proximate to the exit end of the hollow tube.

3. The article of claim 1, wherein the hollow tube has a narrower diameter proximate the exit end of the hollow tube and wherein the hole extending all the way through the wall of the hollow tube is on the narrower diameter portion of the hollow tube.

4. The article of claim 1, wherein the outside diameter of the sleeve is smaller proximate to the dispensing end of the sleeve relative to the average outside diameter of the sleeve.

5. The article of claim 1, wherein the hollow tube and sleeve are independently made of a polymer selected from a group consisting of polyethylene, polypropylene and polytetrafluoroethylene.

6. The article of claim 1, wherein the trigger comprises stopping features (600) that limit the range of motion of the trigger relative to the trigger mount.

7. The article of claim 1, wherein the hollow tube is a first color at the exit end and a second color proximate to the exit end and wherein the sleeve has window (39) extending through it so that the hollow tube extending within the sleeve is visible through window (39), where the window (39) is located on the sleeve such that when the sleeve is in a closed position the first color of the hollow tube is apparent through the window and when the sleeve is in an open position the second color of the hollow tube is apparent through the window.

8. The article of claim 1, wherein the hollow tube comprises at least two pieces, one of which is a removable tip that defines the one or more than one opening (28) of the hollow tube and extends for less than half of the length of the hollow tube.

9. The article of claim 1, wherein the dispensing device is attached to the valve stem of a container so that the contents of the container can flow through the valve stem and into the flow channel of the hollow tube.

10. The article of claim 1 wherein the dispensing device is free of a position indicator.

* * * * *